US007717281B2

(12) United States Patent
Baudin

(10) Patent No.: US 7,717,281 B2
(45) Date of Patent: May 18, 2010

(54) CLOSURE CAP WITH A SEALING STUD HAVING INCREASED DEFORMABILITY AND A RECEPTACLE FITTED WITH SUCH A CAP

(75) Inventor: Gilles Baudin, Domont (FR)

(73) Assignee: L'Oreal, Paris (FR)

( * ) Notice: Subject to any disclaimer, the term of this patent is extended or adjusted under 35 U.S.C. 154(b) by 982 days.

(21) Appl. No.: 11/046,773

(22) Filed: Feb. 1, 2005

(65) Prior Publication Data

US 2005/0173366 A1 Aug. 11, 2005

Related U.S. Application Data

(60) Provisional application No. 60/551,810, filed on Mar. 11, 2004.

(30) Foreign Application Priority Data

Feb. 6, 2004 (FR) ..... 04 50219

(51) Int. Cl.
*B65D 43/14* (2006.01)
*B65D 47/08* (2006.01)

(52) U.S. Cl. ..... 215/235; 215/354; 220/837; 220/839; 222/546; 222/556; 222/563; 222/554; 222/562

(58) Field of Classification Search ..... 220/839, 220/787, 800, 786; 222/546, 548, 556, 554, 222/562, 563; 215/354, 235, 237; 264/260
See application file for complete search history.

(56) References Cited

U.S. PATENT DOCUMENTS

| | | | | |
|---|---|---|---|---|
| 2,717,728 | A * | 9/1955 | Gray | 222/546 |
| 2,820,564 | A * | 1/1958 | Solomon | 215/231 |
| 2,921,716 | A * | 1/1960 | Schiller | 222/92 |
| 3,023,925 | A * | 3/1962 | Sher | 220/786 |
| 3,025,991 | A * | 3/1962 | Gillon | 215/311 |
| 3,741,447 | A * | 6/1973 | Miles et al. | 222/517 |
| 5,169,035 | A * | 12/1992 | Imbery, Jr. | 222/212 |
| 5,388,731 | A * | 2/1995 | Mengeu et al. | 222/545 |
| 6,202,887 | B1 * | 3/2001 | Petit | 220/849 |

FOREIGN PATENT DOCUMENTS

| | | |
|---|---|---|
| DE | 78 12 284 U1 | 12/1979 |
| FR | 2 771 386 | 5/1999 |
| GB | 2 166 123 A | 4/1986 |

* cited by examiner

*Primary Examiner*—Robin Hylton
(74) *Attorney, Agent, or Firm*—Oliff & Berridge, PLC

(57) ABSTRACT

A closure cap may include a base portion and a lid. The base portion may include a dispenser orifice. The lid may include a sealing stud arranged to be engaged in the dispenser orifice when the lid is closed. The sealing stud may comprise at least one portion in relief arranged to snap-fasten in the base portion. The sealing stud may also include an elastically deformable zone of increased deformability, in which at least part of the portion in relief may be formed.

21 Claims, 4 Drawing Sheets

CLOSURE CAP WITH A SEALING STUD HAVING INCREASED DEFORMABILITY AND A RECEPTACLE FITTED WITH SUCH A CAP

This non-provisional application claims the benefit of French Application No. 04 50219 filed on Feb. 6, 2004 and U.S. Provisional Application No. 60/551,810 filed on Mar. 11, 2004, the entire disclosures of which are incorporated by reference herein.

BACKGROUND

The present invention relates to improving closure caps.

Some substances, in particular cosmetics, are made available in receptacles fitted with closure caps comprising a base portion fixed by snap-fastening on a neck of the receptacle, and a lid hinged onto the base portion. Said base portion includes a dispenser orifice, and the lid is provided with a sealing stud that becomes engaged in the dispenser orifice when the lid is closed. In order to produce a click when the lid is opened or closed, two diametrally opposite bumps are formed on the outside surface of the sealing stud.

SUMMARY

Such a sealing stud is subjected to wear as a result of the lid being opened and closed many times, such that the bumps are no longer capable of fulfilling their function in a satisfactory manner as the receptacle reaches the end of its lifetime.

Exemplary embodiments of the present invention provide a closure cap comprising a base portion and a lid, the base portion including a dispenser orifice, and the lid including a sealing stud arranged to be engaged in the dispenser orifice when the lid is closed. In exemplary embodiments, the sealing stud comprises at least one portion in relief arranged to snap-fasten in the base portion.

In exemplary embodiments, in the closure cap, the sealing stud may include an elastically deformable zone of increased deformability, in which at least part of the portion in relief may be formed.

For example, said portion in relief may comprise a bump, which may be formed on an outside surface of the sealing stud, for example.

According to exemplary embodiments of the invention, the amount of wear on the portion in relief is small, since said portion in relief is subjected to smaller stresses when the lid is opened and closed, for example, as a result of said portion in relief being located on the zone of increased deformability.

Exemplary embodiment of the invention may apply, for example, to closure caps in which the lid is hinged to the base portion. Exemplary embodiment of the invention may also be used when the lid is arranged to be mounted onto the base portion in some other way, for example, by screw fastening.

In exemplary embodiments, the dispenser orifice may be defined by an annular lip situated inside the base portion.

In exemplary embodiments, the zone of increased deformability may extend over less than one complete turn about a longitudinal axis of the sealing stud.

In exemplary embodiments, the zone of increased deformability may be defined by a relatively thin region of the sealing stud. For example, said sealing stud may include an internal or external groove which defines the relatively thin region. For example, said relatively thin region may have a thickness that is less than an average thickness of the stud excluding (outside) the relatively thin region, for example, substantially equal to or less than half the average thickness of the stud excluding the relatively thin region.

In exemplary embodiments, the sealing stud may include two diametrally opposite zones of increased deformability. Each zone of increased deformability may have a thickness that is less than a thickness of the stud between the two zones of increased deformability, for example, less than half of said thickness. Each zone of increased deformability may be defined by a groove on a radially inside surface of the stud.

In other exemplary embodiments, the zone of increased deformability may also be defined by a tongue. For example, said tongue may be connected to a remainder of the sealing stud in such a manner as to include a free edge at an end via which the sealing stud is inserted into the dispenser orifice. For example, a thickness of the tongue may be substantially equal to a thickness of a remainder of a wall of the sealing stud.

In exemplary embodiments, the sealing stud may include a plurality of tongues, for example, three tongues, that are evenly distributed angularly around a longitudinal axis of the sealing stud. For example, each tongue may include, on a radially outside surface thereof, a step that serves as a portion in relief arranged to snap-fasten in the base portion.

In exemplary embodiments, the dispenser orifice may include a first portion and a second portion that is greater in section than the first portion. The portion in relief may be positioned facing the second portion when the lid is closed, with the cap being sealed by contact between the sealing stud and a wall defining the first portion, when the cap is closed. The first and second portions may be connected together by a shoulder. The second portion may have a cross-section that is large enough to ensure that, when the lid is closed, the portion in relief is substantially not compressed against a wall defining the dispenser orifice.

In exemplary embodiments, the stud and the dispenser orifice may be arranged in such a manner that the portion in relief snap-fastens below the dispenser orifice.

For example, the sealing stud may have a length that is greater than a length of the dispenser orifice.

In exemplary embodiments, the sealing stud may include a beveled end, and the portion in relief may be situated set back from said beveled end.

In exemplary embodiments, the portion in relief may comprise a substantially spherically-shaped bump, for example. An apparent thickness of the portion in relief at a surface of the sealing stud may lie in a range of about 0.03 millimeters (mm) to about 0.3 mm, for example. Preferably, the apparent thickness may lie in a range of about 0.1 mm to about 0.15 mm.

In exemplary embodiments in which the sealing stud includes two diametrally opposite zones of increased deformability, each portion in relief may comprise a substantially spherically-shaped bump, for example. The bump may project about 0.15 mm from a radially outside surface of the stud, for example.

In exemplary embodiments, the base portion may include a mounting skirt for mounting onto a neck of a receptacle. The mounting skirt may be configured to snap-fasten on the neck, for example.

In exemplary embodiments, the closure cap may be advantageously a single piece, for example, being made by injection molding a plastics material.

A non-limiting list of materials which may be used to make the closure cap includes: polypropylene homopolymer or copolymer, high-density or medium-density polyethylene. Medium-density polyethylene is a mixture of high-density and low-density polyethylene.

In exemplary embodiments, the closure cap may also be dual-injected. The sealing stud may be made of a first material, and a remainder of the cap may be made of a second material that is different from the first. For example, the first and second materials may have different hardness.

For example, the sealing stud may be made of polypropylene homopolymer, and the remainder of the closure cap may be made of polypropylene copolymer, or vice versa.

The sealing stud may also be made of polypropylene, and the remainder of the closure cap may be made of a mixture of polypropylene and an elastomer, or vice versa.

In embodiments in which the lid is hinged onto the base portion, the closure cap may include at least one resilient strip connecting the lid to the base portion.

In exemplary embodiments, the portion in relief may be disposed facing a film-hinge connecting the lid to the base portion.

In exemplary embodiments, the sealing stud may include two portions in relief, one above the other along a longitudinal axis of the sealing stud, so as to generate two clicks.

Exemplary embodiments of the invention may also provide a receptacle fitted with such a closure cap.

BRIEF DESCRIPTION OF THE DRAWINGS

The invention will be better understood on reading the following detailed description of non-limiting embodiments thereof, and on examining the accompanying drawings, in which.

DETAILED DESCRIPTION OF EMBODIMENTS

Figure 1:
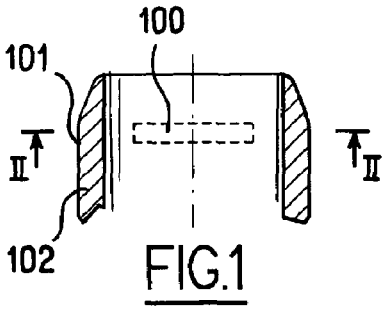
FIG.1 RELATED ART
FIG. 1 is a fragmentary, longitudinal cross sectional view of a known sealing stud.
Figure 3:
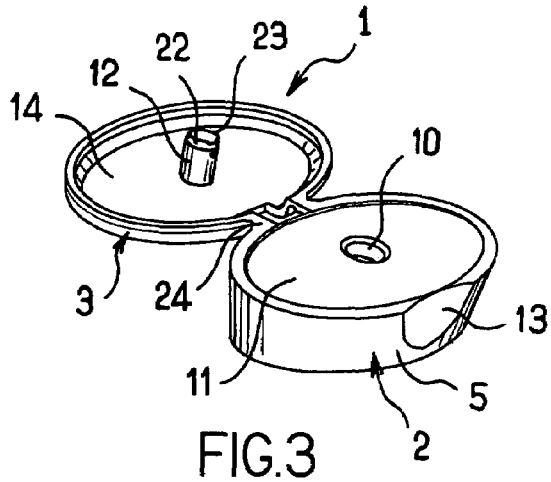
FIG. 3 is a diagrammatic, perspective view of an exemplary embodiment of a closure cap, the lid being open.
Figure 2:
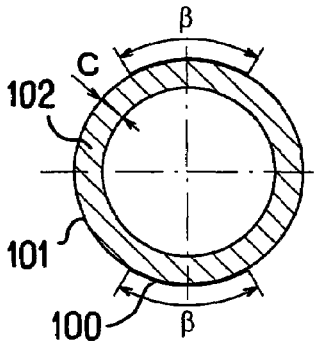
FIG.2 RELATED ART
FIG. 2 is a cross sectional view taken along II-II in FIG. 1.
Figure 4:
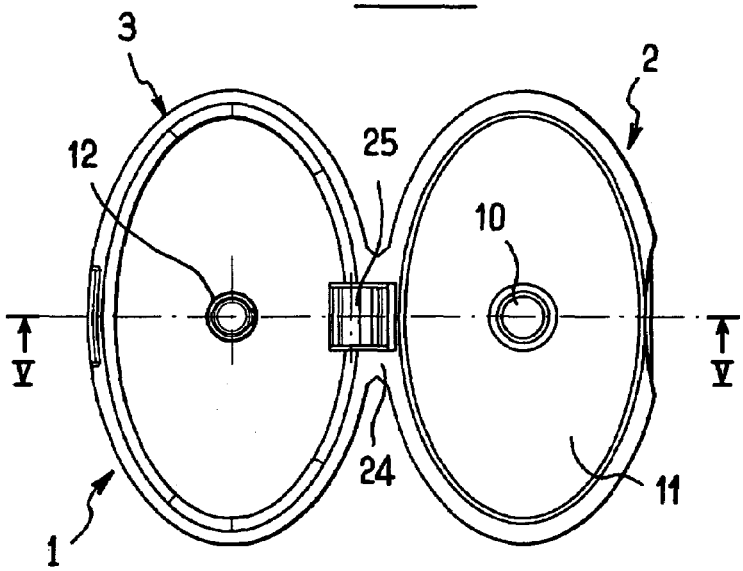
FIG. 4 is a plan view of the cap of FIG. 3.

FIGS. 1 and 2 show a sealing stud 102 of a known closure cap. The sealing stud 102 includes two diametrally opposite bumps 100 projecting from an outside surface 101 thereof. Each bump 100 extends over a 60° angular sector β around the longitudinal axis of the stud. In the section plane in FIG. 2, the tubular wall of the sealing stud has a constant thickness c outside the bumps 100.

An exemplary closure cap 1 in accordance exemplary embodiments of the invention is shown in FIGS. 3 to 9. The closure cap 1 may comprise a base portion 2 for fixing onto a receptacle (not shown), and a lid 3 hinged onto the base portion 2 by a film-hinge 24.

Figure 5:
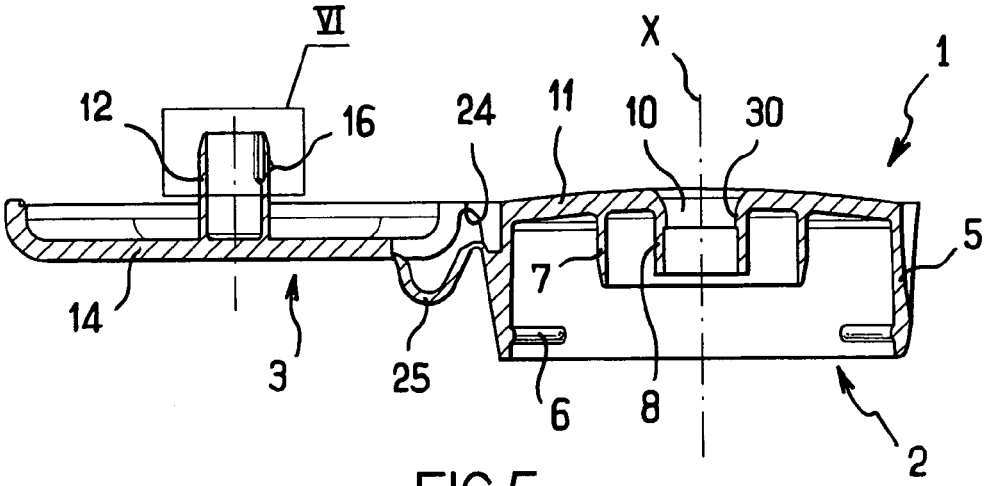
FIG. 5 is a cross sectional view in a mid-plane taken along V-V in FIG. 4.

As shown in FIG. 5, for example, the base portion 2 may include a mounting skirt 5 arranged to snap-fasten on a neck of the receptacle. For this purpose, the mounting skirt 5 may include projections 6 on an inside surface thereof.

The base portion 2 may also include a first annular sealing lip 7 of axis X arranged to bear in a leaktight manner against an inside surface of the neck, and a second annular sealing lip 8 that is coaxial inside the first annular sealing lip 7 and that defines a dispenser orifice 10 through which the substance contained in the receptacle can be dispensed.

A top of the mounting skirt 5 and tops of the sealing lips 7 and 8 may be connected to a top wall 11 constituting a top of the base portion 2.

The lid 3 may comprise a dish-shaped wall 14 that comes to cover the base portion 2 in the closed position, and a sealing stud 12 for closing the dispenser orifice 10 in a sealed manner.

A recess 13 may be formed on the base portion 5, on the side that is opposite the film-hinge 24, so as to make it easier for a user to lift up the lid 3 by a thumb, for example.

Figure 6:
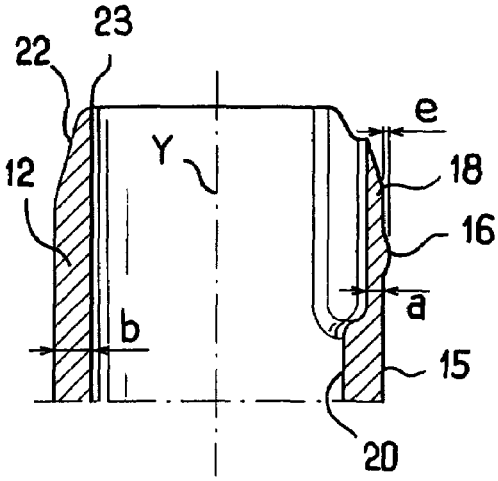
FIG. 6 is a larger-scale view of a detail VI in FIG. 5.
Figure 7:
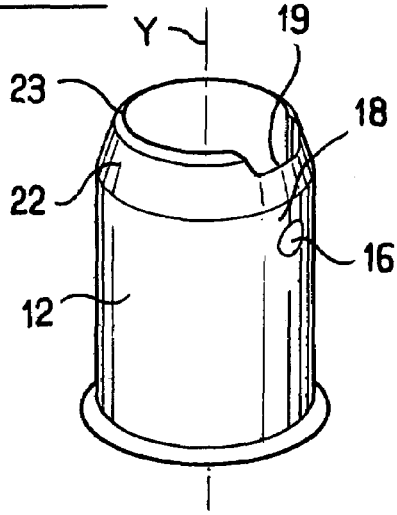
FIG. 7 is a perspective view showing the sealing stud in isolation.
Figure 8:
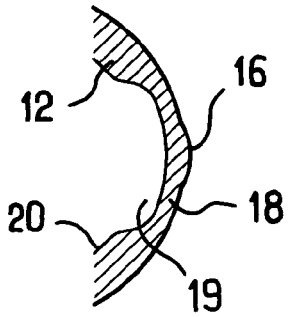
FIG. 8 is a fragmentary cross sectional view of the sealing stud of FIG. 7.
Figure 9:
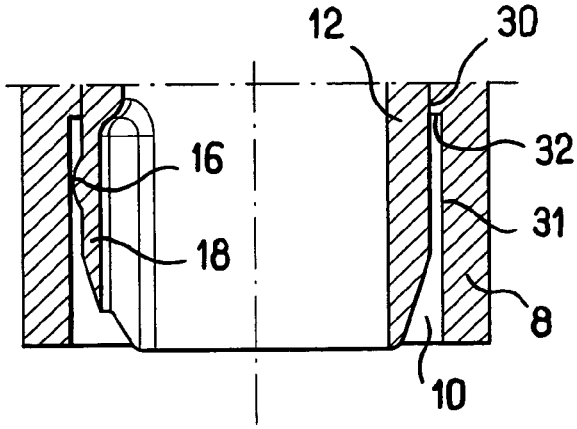
FIG. 9 is a fragmentary and diagrammatic cross sectional view showing the sealing stud engaged inside the dispenser orifice when the lid is closed.

With reference to FIGS. 6 to 8, the sealing stud 12 may comprise a tubular wall of axis Y, said tubular wall being substantially perpendicular to the wall 14 of the lid 6. On an outside surface 15 of said tubular wall, there may be a bump 16, which, in the exemplary embodiment, may be in the shape of a portion of a sphere having an apparent thickness e that lies in a range of about 0.03 mm to about 0.3 mm, and, for example, about 0.1 mm.

As shown in FIG. 5, for example, the bump 16 may be preferably formed facing the film-hinge 24.

The sealing stud 12 may include a groove 19 which extends along an inside surface 20, parallel to the axis Y, and which defines a relatively thin region 18.

The relatively thin region 18 may constitute a zone of the stud that is of increased deformability. The bump 16 may be situated in this zone.

A thickness a of the relatively thin region 18 may be less than an average thickness b of the tubular wall of the stud outside (excluding) the relatively thin region 18. For example, the thickness a may be about b/2 or less than b/2. The thickness a may be about 0.25 mm, for example, and the thickness b may be about 0.6 mm.

In the vicinity of a free end 23 thereof, the sealing stud 12 may include a conical surface 22, converging in a direction away from the wall 14 of the lid 3.

The film-hinge 24 may be provided on either side of an elastically deformable strip 25, which, by accumulating energy by elastic deformation, makes it possible to assist the closing and opening movements of the lid in a manner known per se.

The dispenser orifice 10 may include two portions: namely, a first portion 30 which opens out to the outside of the closure cap when the lid 3 is open; and, a second portion 31 that is wider than the first portion, and that opens out to the inside of the closure cap 1. The two portions 30 and 31 may be interconnected, for example, by an annular shoulder 32 of the second sealing lip 8.

When the lid 3 is in the closed position, the sealing stud 12 may bear in a sealed manner against the wall of the base portion in which the first portion 30 of the orifice is defined.

The bump 16 may be positioned on the sealing stud 12 in such a manner that it is then situated in the second portion 31. As shown, the diameter of the second portion 31 may be large enough to prevent the bump 16 from coming substantially into contact with the second sealing lip 8. Thus, the bump 16 may not be compressed against the second sealing lip 8.

When the lid 3 is opened or closed, the bump 16 may clear the first portion 30 of the dispenser orifice 10 by elastic deformation of at least a portion of the relatively thin region 18, thereby generating a click.

Exemplary embodiments of the invention make it possible to reduce the amount of wear on the bump 16 by reducing the stresses exerted thereon while the closure cap 1 is being used. Furthermore, as a result of the presence of the relatively thin region, the closure cap may be unmolded with less risk of damaging the bump 16.

The zone of increased deformability may be provided in ways other than by a relatively thin region 18 of the sealing stud 12.

Figure 10:
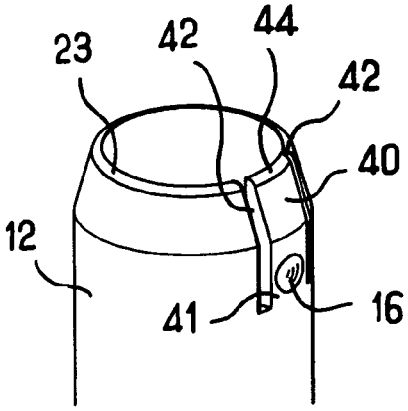
FIG. 10 is a view similar to FIG. 7, showing another exemplary embodiment of a sealing stud.
Figure 11:
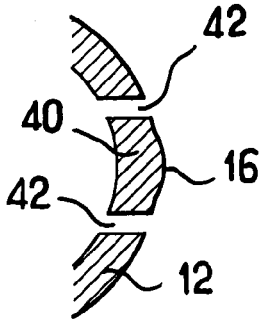
FIG. 11 is a view similar to FIG. 8 showing the sealing stud of FIG. 10.
Figure 12:
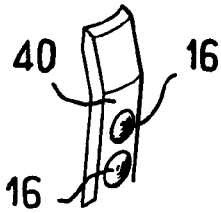
FIG. 12 shows a tongue including two bumps, one above the other along a longitudinal axis of the sealing stud.
Figure 13:
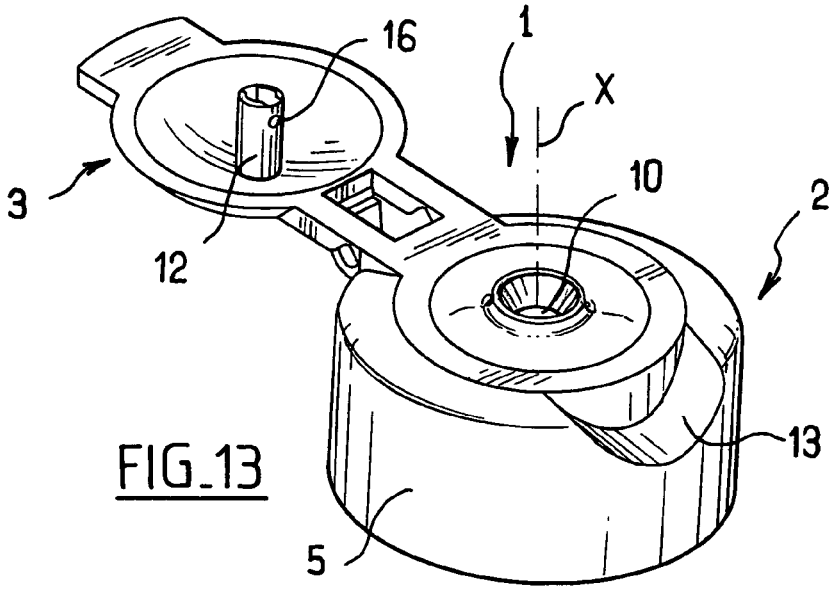
FIG. 13 is a view similar to FIG. 3, showing another exemplary embodiment.
Figure 14:
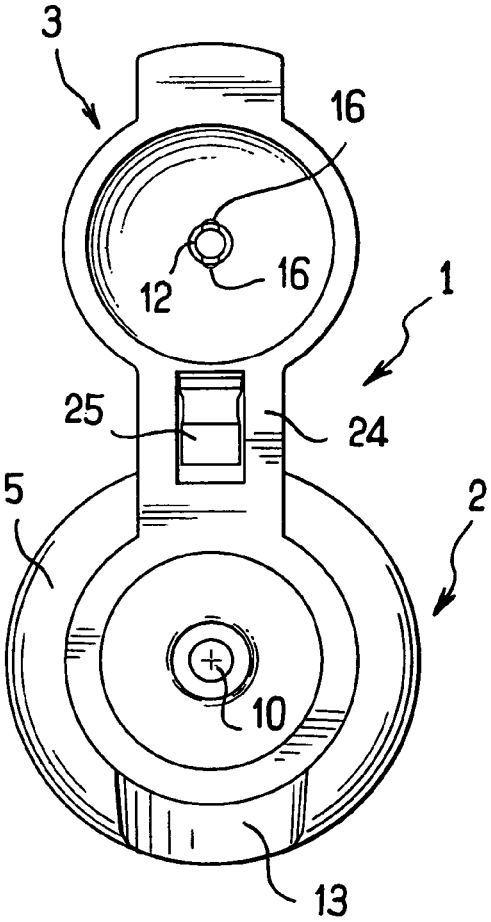
FIG. 14 is a plan view of the cap of FIG. 13.
Figure 15:
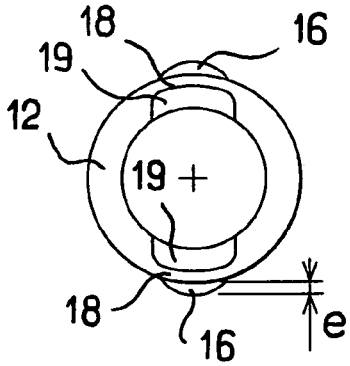
FIG. 15 is a view from below showing, in isolation, the sealing stud of the cap of FIGS. 13 and 14.

For example, FIGS. 10 to 12 show another exemplary embodiment which differs from the above-described embodiment by the absence of the relatively thin region 18. The relatively thin region 18 may be is replaced by two slots 42 extending parallel to the axis Y as far as the free end 23 of the sealing stud 12. The slots 42 may define a tongue 40 therebetween on which the bump 16 may be formed.

The tongue 40 may flex resiliently while the lid is being opened or closed so as to enable the bump 16 to clear the first portion 30.

Naturally, the invention is not limited to the exemplary embodiments described above.

The zone of increased deformability may be made in still other ways, for example, by making the relatively thin region by a groove extending along the outside of the sealing stud 12.

FIGS. 13 to 16 show the possibility of making the sealing stud 12 with two diametrally opposite and substantially spherically-shaped bumps 16 projecting about 0.15 mm from the radially outside surface of the stud. In this exemplary embodiment, the diametral plane containing the tops of the two bumps 16 may be substantially perpendicular to the hinge pin of the lid 3.

The bumps 16 may be formed on relatively thin regions 18 constituting the bottoms of grooves 19 formed in the radially inside surface of the stud 12.

Figure 16:
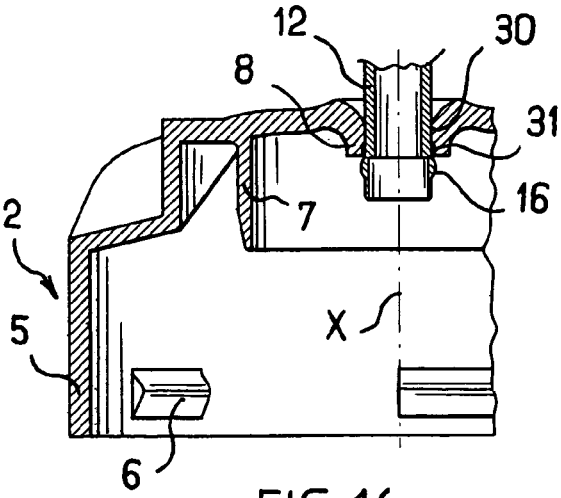
FIG. 16 is a fragmentary and diagrammatic axial cross sectional view showing the sealing stud after it has been inserted into the base portion of the cap.
Figure 17:
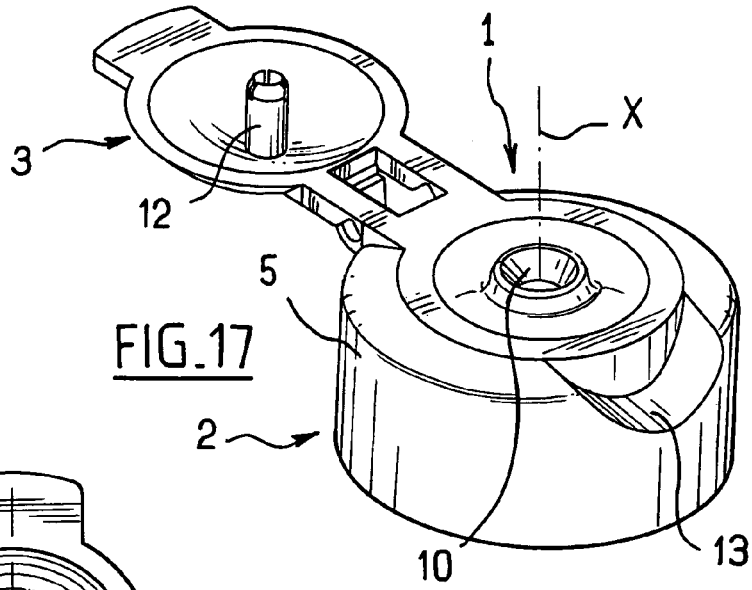
FIG. 17 is a view similar to FIG. 3, showing another variant embodiment.
Figure 18:
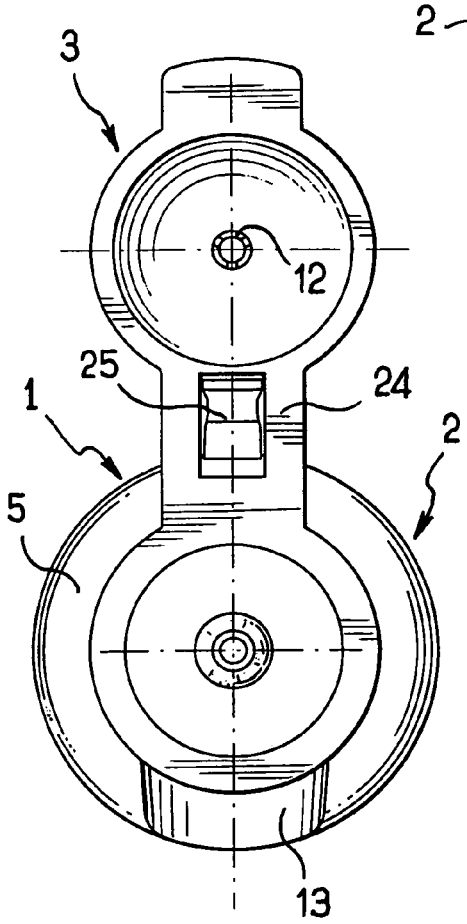
FIG. 18 is a plan view of the FIG. 17 cap.
Figure 19:
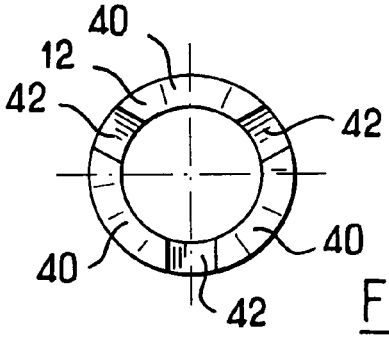
FIG. 19 is a view from below showing, in isolation, the sealing stud of the cap in FIGS. 17 and 18.

As shown in FIG. 16, the bumps 16 may come to be snap-fastened below the sealing lip 8 when the cap 1 is closed.

FIGS. 17 to 20 show the possibility of making the sealing stud 12 with a plurality of tongues 40, for example, three tongues 40, that are evenly distributed angularly around the longitudinal axis of the stud 12.

Figure 20:
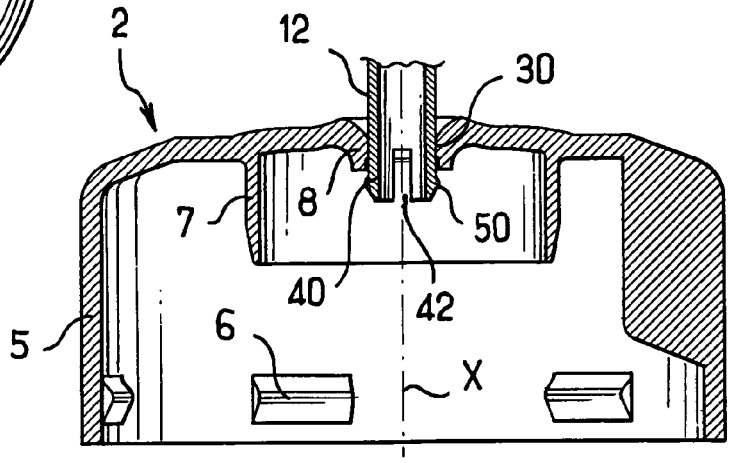
FIG. 20 is a fragmentary and diagrammatic axial section showing the sealing stud inserted into the base portion.

Each tongue 40 may include, on a radially outside surface thereof, a step 50 serving to snap-fasten the stud 12 below the sealing lip 8, as shown in FIG. 20.

The sealing stud 12 may also be made with two bumps 16, one above the other along the axis Y, as shown in FIG. 12. The bumps 16 may be carried by the same tongue 40, as shown in FIG. 12, or be formed on the same relatively thin region (not shown), for example. The presence of two superposed bumps 16 makes it possible to generate two clicks.

Where appropriate, the bump 16 may have an annular shape, and the zone of increased deformability may extend over one complete turn about the longitudinal axis of the sealing stud 12.

The dispenser orifice may be formed by an annular lip that is outside the base portion, and the sealing stud may engage the inside or the outside of said annular lip.

The sealing cap may be made entirely of the same material, or may be made of at least two different materials, as described above.

Throughout the description, including in the claims, the term "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A closure cap, comprising:

a base portion comprising a dispenser orifice; and a lid comprising a sealing stud configured to be engaged in the dispenser orifice when the lid is closed, the sealing stud comprising:

at least one portion in relief configured to snap-fasten in the base portion; and an elastically deformable zone of increased deformability, in which at least part of the portion in relief is formed, wherein the zone of increased deformability is defined by a relatively thin region of the sealing stud, and the zone of increased deformability extends over less than one complete turn about a longitudinal axis of the sealing stud.

2. A closure cap according to claim 1, wherein the dispenser orifice is defined by an annular lip situated inside the base portion.

3. A closure cap according to claim 1, wherein the portion in relief comprises a bump.

4. A closure cap according to claim 1, wherein the lid is hinged to the base portion.

5. A closure cap according to claim 1, wherein the sealing stud includes a groove which defines the relatively thin region.

6. A closure cap according to claim 5, wherein the groove is inside the sealing stud.

7. A closure cap according to claim 1, wherein the relatively thin region has a thickness that is less than half an average thickness of the stud excluding the relatively thin region.

8. A closure cap, comprising:

a base portion comprising a dispenser orifice; and a lid comprising a sealing stud configured to be engaged in the dispenser orifice when the lid is closed, the sealing stud comprising:

at least one portion in relief configured to snap-fasten in the base portion; and an elastically deformable zone of increased deformability, in which at least part of the portion in relief is formed, wherein the zone of increased deformality is defined by a relatively thin region of the sealing stud, and the sealing stud comprises two diametrally opposite zones of increased deformability, each zone of increased deformability being of a thickness that is less than a thickness of the stud between the two zones of increased deformability, each zone of increased deformability being defined by a groove on a radially inside surface of the stud.

9. A closure cap according to claim 8, wherein each zone of increased deformability is of a thickness that is less than half a thickness of the stud between the two zones of increased deformability, each zone of increased deformability being defined by a groove on a radially inside surface of the stud.

10. A closure cap according to claim 8, wherein each portion in relief comprises a substantially spherically-shaped bump projecting about 0.15 mm from a radially outside surface of the stud.

11. A closure cap according to claim 1, wherein the sealing stud includes a beveled end, and wherein the portion in relief is situated set back from said beveled end.

12. A closure cap according to claim 1, wherein the portion in relief comprises a substantially spherically-shaped bump.

13. A closure cap according to claim 1, wherein an apparent thickness of the portion in relief at a surface of the sealing stud lies in a range of about 0.03 mm to about 0.3 mm.

14. A closure cap according to claim 1, wherein an apparent thickness of the portion in relief at a surface of the sealing stud is about 0.15 mm.

15. A closure cap according to claim 1, wherein the base portion includes a mounting skirt for mounting onto a neck of a receptacle.

16. A closure cap according to claim 4, the closure cap being a single piece.

17. A closure cap according to claim 16, wherein the lid is hinged to the base portion via at least one resilient strip connecting the lid to the base portion.

18. A closure cap, comprising:

a base portion comprising a dispenser orifice; and a lid comprising a sealing stud configured to be engaged in the dispenser orifice when the lid is closed, the sealing stud comprising:

at least one portion in relief configured to snap-fasten in the base portion; and an elastically deformable zone of increased deformability, in which at least part of the portion in relief is formed, wherein the zone of increased deformality is defined by a relatively thin region of the sealing stud, and the sealing stud includes two portions in relief, one above the other along a longitudinal axis of the sealing stud.

19. A closure cap according to claim 16, wherein the lid is hinged to the base portion by a film-hinge.

20. A closure cap according to claim 19, the closure cap being dual-injected, the sealing stud comprising a first material, and a remainder of the cap comprising a second material that is different from the first material.

21. A receptacle fitted with a closure cap, the closure cap comprising:

a base portion comprising a dispenser orifice; and a lid comprising a sealing stud configured to be engaged in the dispenser orifice when the lid is closed, the sealing stud comprising:

at least one portion in relief configured to snap-fasten in the base portion; and an elastically deformable zone of increased deformability, in which at least part of the portion in relief is formed, wherein the zone of increased deformability is defined by a relatively thin region of the sealing stud, and the zone of increased deformability extends over less than one complete turn about a longitudinal axis of the sealing stud.

* * * * *